United States Patent [19]

Kramer

[11] 4,230,260

[45] Oct. 28, 1980

[54] FOLDABLE PROTECTIVE PACKAGING SLEEVE OR CARTON

[75] Inventor: Robert G. Kramer, Cincinnati, Ohio

[73] Assignee: Diamond International Corporation, New York, N.Y.

[21] Appl. No.: 57,527

[22] Filed: Jul. 13, 1979

[51] Int. Cl.[3] ..... B65D 25/14; B65D 5/58

[52] U.S. Cl. ..... 229/39 B

[58] Field of Search ..... 229/39 B, 37

[56] References Cited

U.S. PATENT DOCUMENTS

| | | | |
|---|---|---|---|
| Re. 23,670 | 6/1953 | Currivan | 229/39 B X |
| 3,047,203 | 7/1962 | Etlinger | 229/39 B |
| 3,059,830 | 10/1962 | Kramer | 229/39 B |
| 3,232,513 | 2/1966 | Maio | 229/39 B X |
| 3,400,879 | 9/1968 | OBrien et al. | 229/39 B |
| 3,923,235 | 12/1975 | Roccaforte | 229/39 B |
| 3,941,304 | 3/1976 | Barbieri | 229/39 B |
| 3,968,924 | 7/1976 | Tyrseck | 229/39 B |

*Primary Examiner*—Davis T. Moorhead
*Attorney, Agent, or Firm*—Karl W. Flocks

[57] ABSTRACT

Foldable packaging member for tubes in erected condition comprising: pairs of parallel panels, one of the pairs constituting first and third side walls, the other pair constituting second and fourth side walls, the second, third, and fourth side walls extending successively from the first side wall along mutually parallel fold lines, the fourth side wall having an integral assembly panel extending beneath and adhered to an adjacent inside portion of the first side wall, the assembly panel including an elongate band along the adjacent inside portion of the first side wall for substantially the length thereof and a short band disposed beneath and adhered to the adjacent inside portion of the first side wall at one end thereof, the elongate band having an integral flap extending from one edge thereof toward the third side wall, the short band having a dome support on one edge thereof and adhered to an inside portion of the third side wall opposite the first side wall whereby the dome support extends from the first side wall to the third side wall adjacent one end of the member and is secured at opposite ends to the member, the flap being deflectable toward the one of the second and fourth side walls by a tube inserted into the member to minimize impact between the tube and resistance which might be encountered on that one of the second and fourth side walls, the dome support having a hinged projection adhered to the third side wall.

12 Claims, 14 Drawing Figures

FOLDABLE PROTECTIVE PACKAGING SLEEVE OR CARTON

BACKGROUND OF THE INVENTION

1. Field of the Invention

This invention relates to a packaging sleeve or carton for electronic tubes of the type used in radios, television sets, and other appliances. More particularly this invention relates to a foldable protective packaging sleeve or carton of paperboard material and a paperboard blank from which such a sleeve or carton may be assembled.

2. Description of the Prior Art

Prior art examples of packaging sleeves or cartons of the general class to which the present invention belongs is represented by U.S. Pat. Nos. RE. 23,670 (Currivan), No. 3,059,830 (Kramer), and No. 3,941,304 (Barbieri et al). The Currivan patent shows a packaging sleeve construction generally similar to that of the disclosed invention disclosed herein, but does not include a secured dome support element which may be manufactured from one size of blank but optionally assembled in different lengths or secured at different locations to accommodate tubes of different size or contour.

The Kramer patent relates to packaging sleeve construction comprising an inner protective sleeve assembled within an outer sleeve.

The Barbieri et al patent also relates to a packaging sleeve including bulb holding portions.

SUMMARY OF THE INVENTION

The present invention relates to a new foldable protective packaging sleeve or carton of paperboard material for an electronic tube or the like, which is an improvement over the devices of the prior art cited above.

An object of the present invention is to provide a foldable paperboard sleeve or carton which can aptly be hand loaded or set up and loaded on automatic packaging machinery.

Another object of the present invention is to provide a packaging sleeve or carton which will provide adequate protection to fragile electronic tubes or the like during shipment, handling, and storage.

It is a further object of the present invention to provide an improved packaging sleeve or carton assembled from a blank of preselected size, but having the versatility of being adaptable to being assembled internally for any of several different sized tubes without sacrificing the protective characteristics thereof.

It is yet another object of the present invention to provide an improved packaging sleeve or carton requiring less material.

Still another object of the present invention is to provide a new and improved packaging sleeve or carton requiring less time in its production.

DETAILED DESCRIPTION OF THE INVENTION

Figure 1:
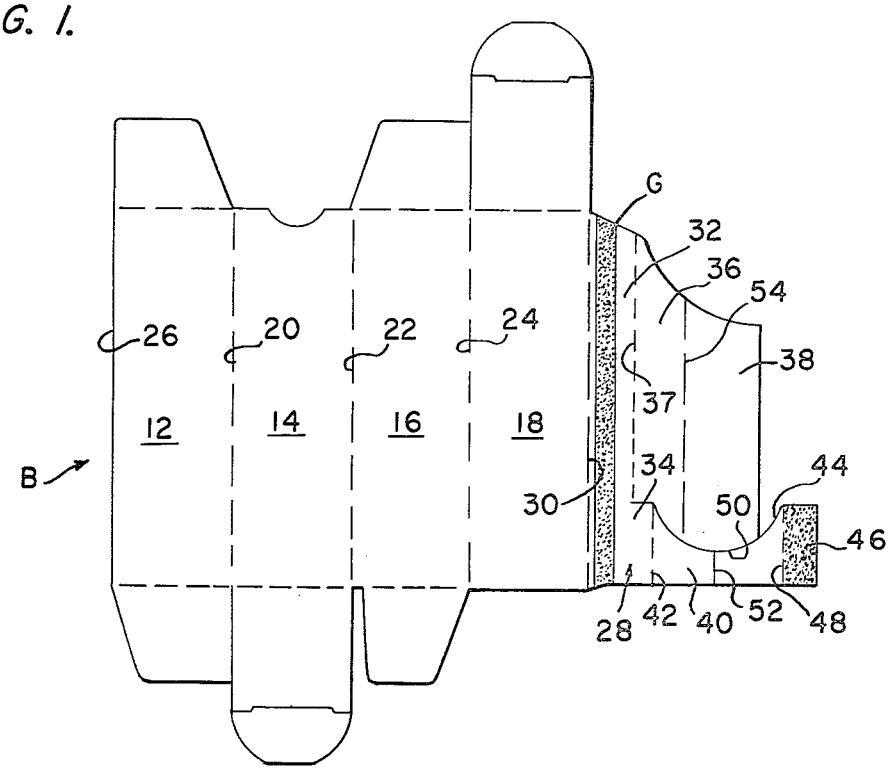
FIG. 1 is a plan view of the outer surfaces of a blank from which the packaging sleeve or carton of the present invention may be assembled.
Figure 2:
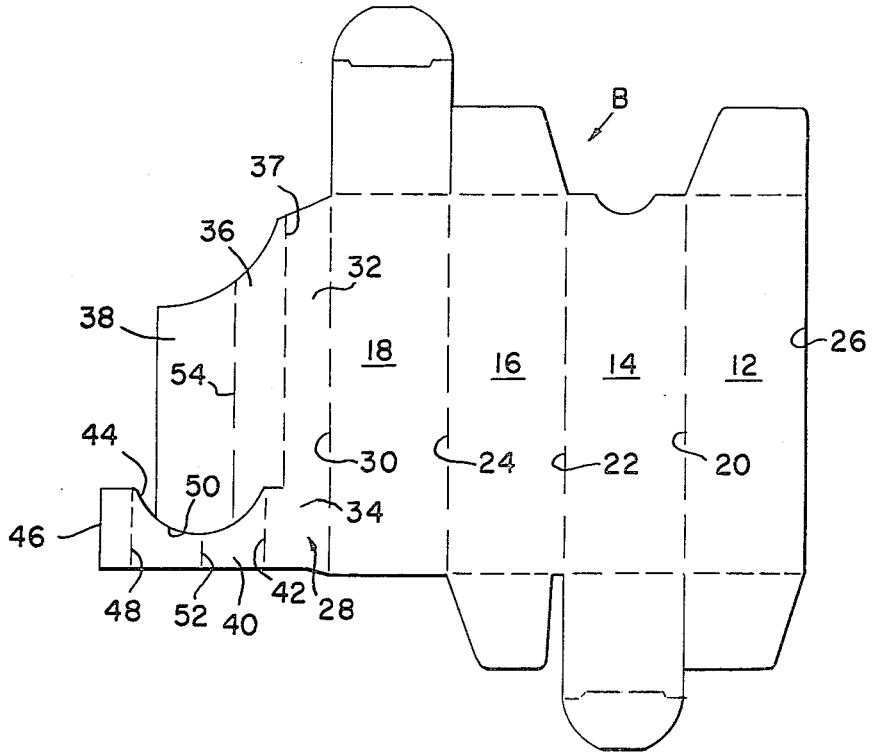
FIG. 2 is a plan view of the inner surfaces of the blank of FIG. 1.
Figure 3:
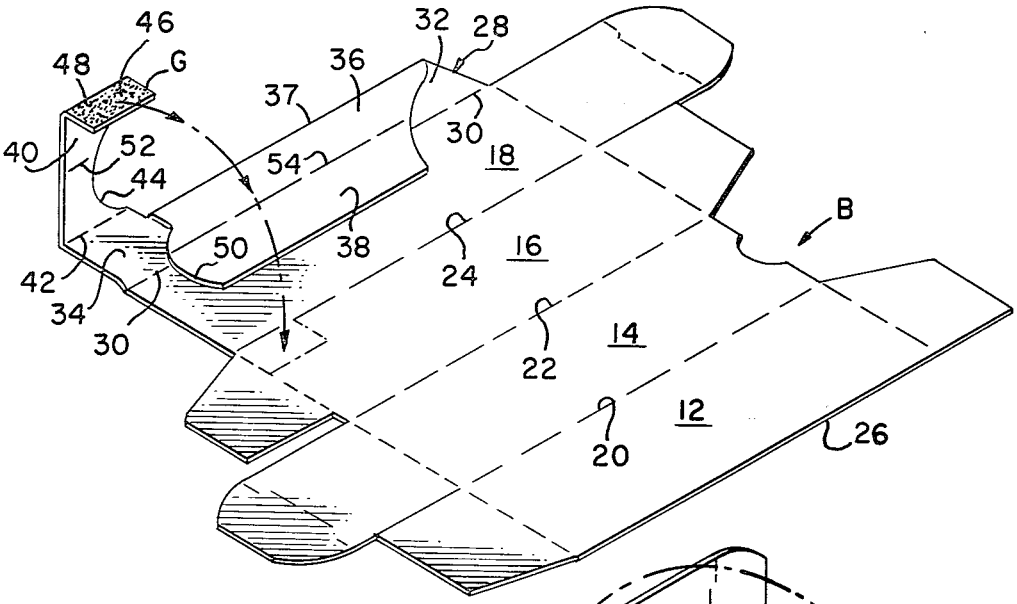
FIG. 3 is a view in perspective showing initial steps for assembling a packaging sleeve or carton from the blank of FIGS. 1 and 2.
Figure 4:
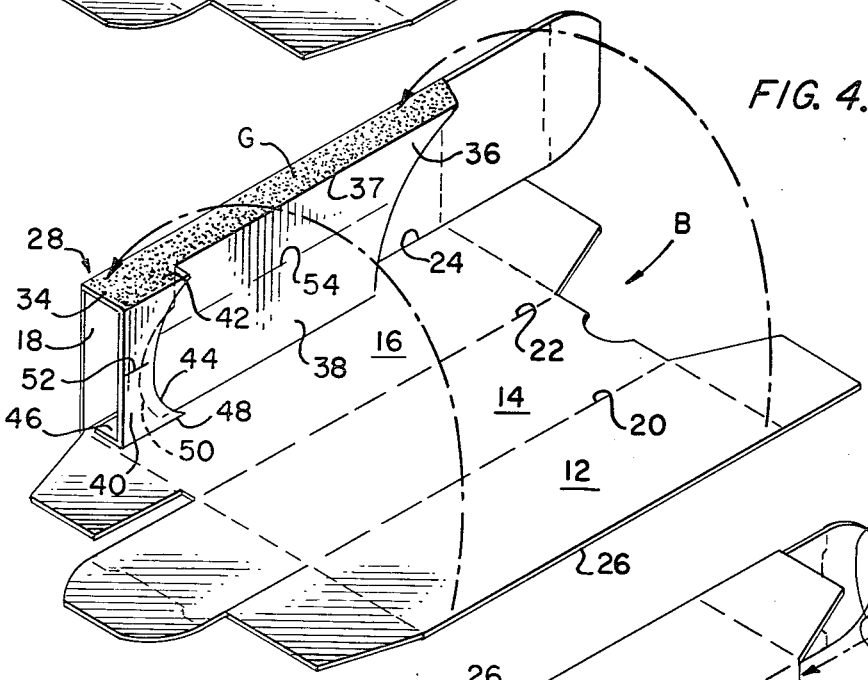
FIG. 4 is a view in perspective similar to FIG. 3, but showing the blank in an advanced stage of assembly.
Figure 5:
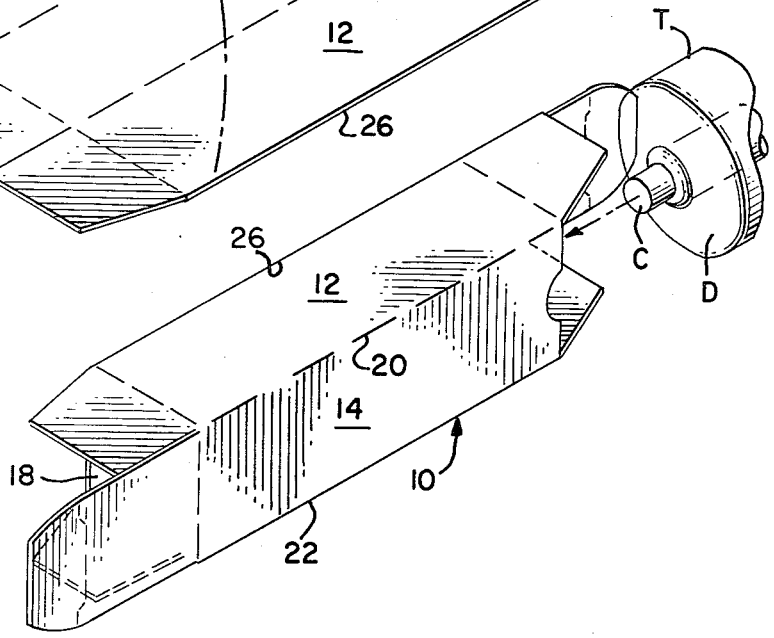
FIG. 5 is a view in perspective showing a packaging sleeve or carton in assembled and erected condition ready to receive a tube to be contained and protected therein.

Referring now to the drawings in detail, the reader will readily appreciate that the packaging sleeve or carton 10 in FIG. 5 may be assembled from the blank B illustrated in FIGS. 1 and 2 by going through at least the steps illustrated and suggested in FIGS. 3 and 4. FIG. 1 shows the blank B for assembling sleeve 10 with four successive generally rectangular main panels 12, 14, 16, 18 extending along successive fold lines 20, 22, 24 spaced from and mutually parallel to each other and to an edge 26 of the first main panel 12. The fourth main panel 18 has an assembly panel 28 integral therewith along a further fold line 30, which is also parallel to edge 26. Assembly panel 28 includes an elongate, relatively narrow band portion 32 extending for the major portion of the length of assembly panel 28 and a short, relatively wide band portion 34 disposed adjacent one end of assembly panel 28. Relatively narrow band portion 32 has a projection 36 integrally hinged thereto along fold line 37 for forming a flexible cushioning flap 38 with a free or unattached edge. Relatively wide band portion 34 has an extension 40 integrally hinged thereto along a hinge line 42 for forming a dome support member 44. Extension 40 also has a further projection 46 which may be secured to the inside surface of the third main panel 16 in assembly. The further projection 46 is foldable along an edge 48 for extension 40. To facilitate assembly gule G may be applied to assembly panel 28 and projection 46 or alternatively to portions of main panels 12 and 16, respectively, on which they will be adhered in assembled conditon of sleeve 10. The lower edge 50 of projection 36 is complementary to dome support member 44 and are cut along such edges 48, 50 to allow separate movement thereof.

To form and assemble sleeve 10 from blank B fourth main panel 18 is rotated inwardly along fold line 24 so as to extend at a right angle to third main panel 16; assembly panel 28, which includes narrow band portion 32 and wide band portion 34, is rotated inwardly along fold line 30, as indicated by the arcuate arrow in FIG. 3, so as to extend at a right angle to fourth main panel 18; projection 36 is rotated inwardly along fold line 37 so as to extend adjacent to fourth main panel 18; extension 40 is then rotated inwardly along hinge line 42 so as to extend toward third main panel 16; and projection 46 is rotated inwardly along edge 48 so as to extend with glue G in contact with and adhered to an adjacent portion of third main panel 16. It is important in the assembly steps disclosed thus far that rotation of projection along fold line 37 proceed before rotation of extension 40 along hinge line 42 notwithstanding the complementary relationship of lower edge 50 and dome support member 44 since the offset relationship between fold line 37 and hinge line 42 will effect an offset relationship between lower edge 50 and dome support member 44, as may be seen in FIG. 4. For if dome support member 44 were to be assembled first then lower edge 50 must be forcibly pushed over dome support member 44 in spite of any complementary relationship therebetween. Assembly of sleeve 10 may be completed from this point by rotating second main panel 14 inwardly along fold line 22 and first main panel 12 inwardly along fold line 20 in the direction of the arrows in FIG. 4 so that second main panel 14 and first main panel 12 extend at right angles from third main panel 16 and second main panel 14, respectively. First main panel 12 is then adhered to assembly panel 28 by glue G with edges 26 and 30 adjacent to each other.

It is also noted that extension 40 includes a crease line 52 and projection 36 includes a crease line 54 as illustrated for example in FIG. 1. The usefulness of crease line 52 will be particularly significant in the assembled carton to be described hereinbelow. As is conventional blank B and sleeve 10 will include various end flaps and cover which are not numbered herein.

Figure 6:
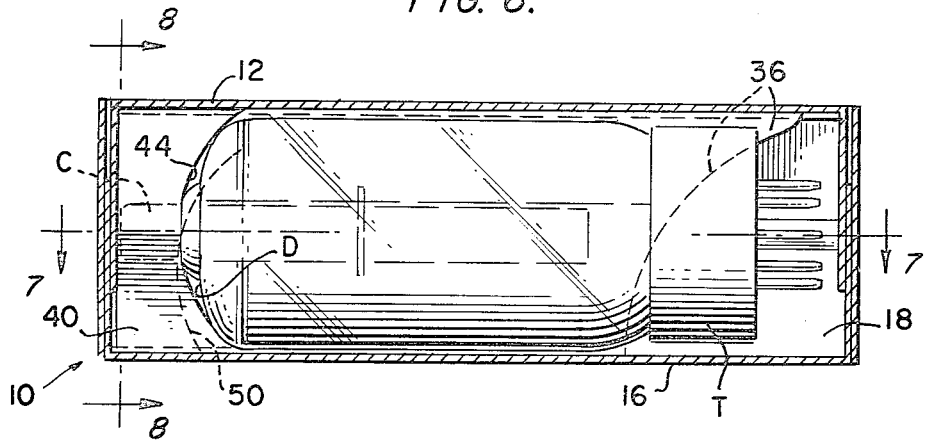
FIG. 6 is a sectional elevational view of the assembled sleeve or carton of FIG. 5 showing one form of tube received therein.
Figure 7:
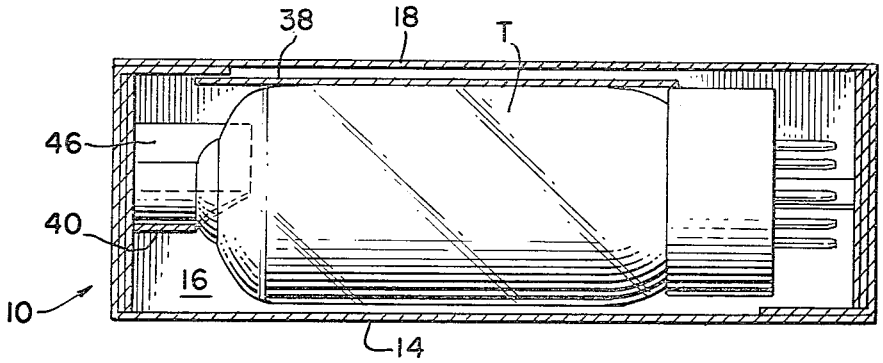
FIG. 7 is a sectional view of the package of FIG. 6 taken along the plane 7—7.
Figure 8:
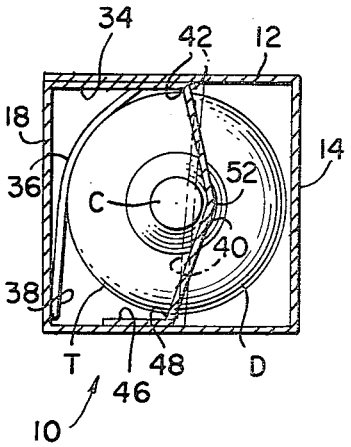
FIG. 8 is a sectional view of the package of FIG. 6 taken along the plane 8—8.

Details of the assembled sleeve 10 which is erected and poised to receive an electronic tube T in FIG. 5 will be readily discerned on consideration of FIGS. 6–8 by the reader. Tube T is of the type provided with a cap C on the end of the dome D. The tube T is shown to be fully enclosed within packaging sleeve on carton 10 in FIG. 6 with sleeve 10 being cut along first panel 12 and third panel 16 whereby second panel 14 is removed to reveal internal details of the package sleeve 10 in use. With due consideration to the description set forth thus far it may be readily understood that the present invention relates to a foldable protective packaging sleeve or carton 10 of paperboard material for an electronic tube T or the like wherein in the erected condition thereof sleeve or carton 10 comprises: two pairs of generally parallel panels 12, 16 and 14, 18, the panels of one of pairs of panels constituting first and third side walls 12, 16 and the panels of the other of pairs of panels constituting second and fourth side walls 14, 18 around carton 10. Second third, and fourth side walls 14, 16, 18 extend successively from first side wall 10 along successive mutually parallel fold lines 20, 22, 24. Fourth side wall 18 has an assembly panel 28 integral therewith and extending beneath and adhered to an adjacent inside portion of first side wall 12. Assembly panel 28 includes an elongate, relatively narrow band portion 32 extending along an adjacent inside portion of first side wall 12 for substantially the entire length thereof and a short, relatively wide band portion 34 disposed beneath and adhered to an adjacent inside portion of first side wall 10 at the end thereof. Relatively narrow band portion 32 has a projection 36 providing a flexible cushioning flap 38 integral therewith and extending from one edge or fold line 37 to a free or unattached edge toward third side wall 16. Relatively wide band portion 34 has a dome support member 44 integral therewith and extending from one edge or hinge line 42 thereof to and adhered to an inside portion of third side wall 16 opposite from first side wall 12 whereby dome support member 44 extends from first side wall 12 to third side wall 16 adjacent one end of carton 10 and is secured at opposite ends thereof to carton 10. Flexible cushioning flap 38 is deflectable toward one of the second and fourth side walls 14, 18 by one side of a tube T inserted into carton 10 to minimize impact between the tube T and any shock which might be encountered on one of second and fourth side walls 14, 18. Dome support member 44 includes a hinged projection 46 along 48 which is adhered to third side wall 16.

Figure 9:
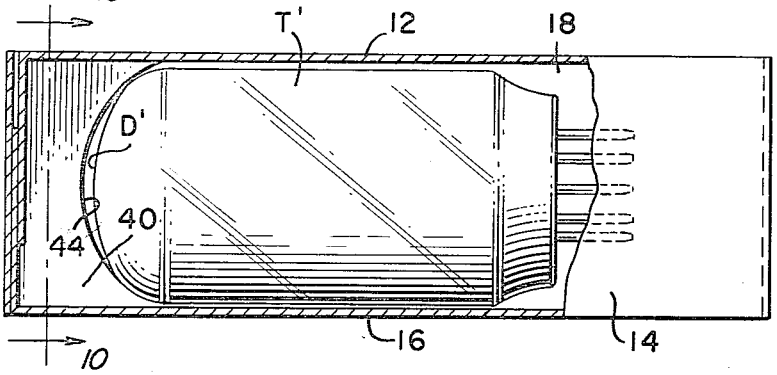
FIG. 9 is a side elevational view of an alternative form and/or use of the carton of FIG. 6 with portions broken away to show a different tube therein.
Figure 10:
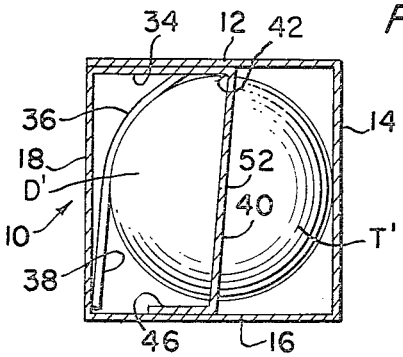
FIG. 10 is a sectional view of the package of FIG. 9 taken along the plane 10—10.

It is within the concept of the present invention to optionally form extension 40 on which dome support member is provided so that it extends across from first main panel 12 to third main panel 16 with an angle at crease line 52 as illustrated in solid lines in FIG. 8 thus allowing cap C of tube T to bypass dome support member 44 or so that it extends straight across without an angle at crease line as illustrated in phantom lines in FIG. 8 and in solid lines in FIG. 10. Formation of extension 40 as desired may be achieved by preforming the width of wide band portion 34 on blank B. For example, wide band portion 34 may be formed with hinge line 42 closer to fold lines 30, 37 whereupon extension 40 will be increased in width to ensure the presence of an angle at crease line 52 when sleeve 10 is erected to accomodate cap C of tube T and reception of dome D on dome support 44. On the other hand wide band portion 34 may be formed with hinge line 42 farther away from fold lines 30, 37 thus increasing the offset therebetween whereupon extension 40 will be decreased in width to the extent that extension 40 will extend between first main panel 12 to third main panel 16 without an angle at crease line 52 with dome D′ of tube T′ received in dome support member 44, as may be seen in FIG. 9. It is also understood that the width of extension 40 may also be controlled by the width of projection 46 which functions as auxiliary assembly flap.

Sleeve 10 in addition to providing support for dome D or D′ by way of dome support member 44 also cushions the side of tube T or T′ by way of flexible cushioning flap 38 which extends from narrow band portion 32 along extension 36 to a free or unattached edge spaced apart from fold line 37 as may be clearly seen in FIG. 4. As narrow band portion 32 is adhered to first main panel 12 in assembly, it will be clear from FIGS. 8 and 10 that in the erected and filled condition of sleeve 10 extension 36 extends from first main panel 12 over a lateral portion of tube T or T′ to flexible cushioning flap 38 which presses resiliently against fourth main panel 18.

In addition to the features discussed above packaging sleeve or carton 10 is assembled from blank B which is formed in a manner whereby dome support member 44 and cushioning flap 38 comprise complementary concave and convex edges 44, 50, respectively, formed by cutting along a preform or indicated path. Also, dome support member 44 may extend straight across carton 10 from first side 12 to third side wall 16 or across carton 10 along first and second angled portions as determined by the respective widths of either or both the wide band portion 34 and hinged projections 46. Extension 40, on which dome support member 44 is formed, and cushioning flap 38 are provided with hinge lines 52 and 54, respectively, to effect angled or deflectable sections on opposite sides thereof and obtain a degree of flexibility.

ALTERNATIVE EMBODIMENTS OF THE INVENTION

Figure 11:
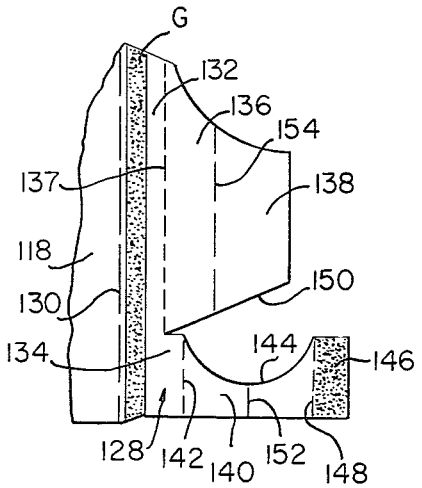
FIG. 11 represents a modified form of the lower right-hand corner of the blank of FIG. 1.
Figure 12:
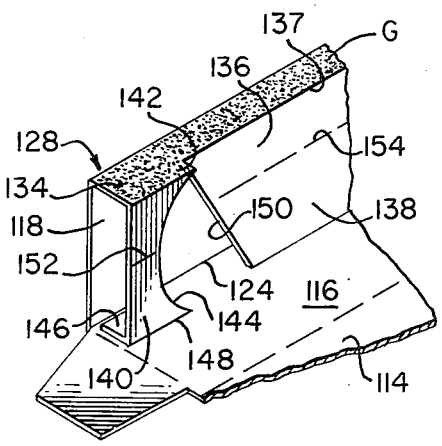
FIG. 12 is a view similar to FIG. 4 showing a fragment of a partially assembled carton using a blank with the modified corner of FIG. 11.

To simplify assembly of the carton according to the present invention, the lower right-hand corner of blank B of FIG. 1 may be modified to the extent of forming projection 36 with arcuate lower edge 50 omitted as may be seen in FIGS. 11 and 12 in which all numbered elements are increased by 100 above corresponding elements of the blank of FIG. 1. Instead of an arcuate lower edge 50, projection 136 in FIG. 11 has a lower straight line edge 150 inclined upwardly from relatively wide band portion 134, and extension 140 on which dome support 144 is formed. From FIG. 12 it is observed that lower edge 150 of flexible cushioning flap 138 will encounter no interference from wide band portion 134 or from extension 140 when flexible cushioning flap 138 is flexed or hinged about fold line 137. Cushioning flap 138 may be seen in FIG. 11 to include a free or unattached edge which is spaced apart from fold line 137. From the foregoing construction, both cushioning flap 138 and extension 140 may be folded simultaneously about fold line 137 and hinge line 142, respectively, during assembly and erection without interference.

Figure 13:
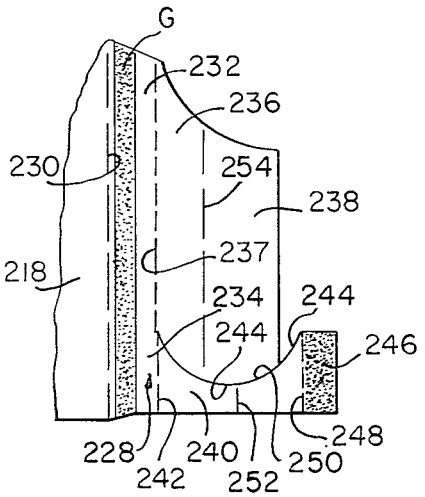
FIG. 13 represents another modified form of the lower right-hand corner of the blank of FIG. 1.
Figure 14:
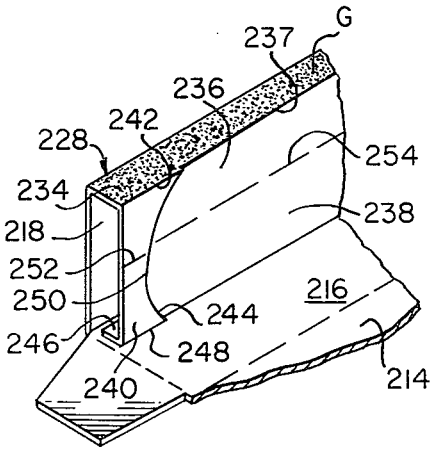
FIG. 14 is a view similar to FIGS. 4 and 12 showing a fragment of a partially assembled carton using a blank with the modified corner of FIG. 13.

In FIGS. 13 and 14 the further alternative form of the lower right-hand corner of blank B the various elements are numbered similar to, but increased by 200 above corresponding elements in FIG. 1. Instead of the offset provided between fold line 37 and hinge line 42 or that provided between fold line 137 and hinge line 142 as illustrated in FIGS. 1 and 11, respectively, fold line 237 and hinge line 242 are formed so as to be substantially in line with little or no offset therebetween as illustrated in FIGS. 13 and 14. With little or no offset between fold line 237 and hinge line 242, cushioning flap 238 and extension 240 may both be flexed or hinged about fold line 237 and hinge line 242 simultaneously without interference during assembly and erection even in the area where lower edge 250 is likely to pass over dome support 244.

As modified, cushioning flap 238 extends from a first relatively elongate band portion 232 along fold line 237 while dome support member 244 extends from a second relatively short band portion 234 along hinge line 242 which is substantially in line with fold line 237. Cushioning flap 238 also includes a free or unattached edge spaced apart from fold line 237.

It will be obvious to those skilled in the art that various changes may be made without departing from the scope of the invention and therefore the invention is not limited to what is shown in the drawings and described in the specification but only as indicated in the appended claims.

What is claimed is:

1. A foldable protective packaging sleeve or carton of paperboard material for an electronic tube or the like, wherein in the erected condition thereof said sleeve or carton comprises: two pairs of generally parallel panels, the panels of one of said pairs of panels constituting first and third side walls and the panels of the other of said pairs of panels constituting second and fourth side walls around said carton, said second, third, and fourth side walls extending successively from said first side wall along successive mutually parallel fold lines, said fourth side wall having an assembly panel integral therewith and extending beneath and adhered to an adjacent inside portion of said first side wall, said assembly panel including an elongate, relatively narrow band portion extending along said adjacent inside portion of said first side wall for substantially the entire length thereof and a short, relatively wide band portion disposed beneath and adhered to said adjacent inside portion of said first side wall at one end thereof, said relatively narrow band portion having a flexible cushioning flap integral therewith and extending from one edge thereof to a free or unattached edge toward said third side wall, said relatively wide band portion having a dome support member integral therewith and extending from one edge thereof to and adhered to an inside portion of said third side wall opposite from said first side wall whereby said dome support member extends from said first side wall to said third side wall adjacent one end of said carton and is secured at opposite ends thereof to said carton, said flexible cushioning flap being deflectable toward said one of said second and fourth side walls by one side of a tube inserted into said carton to minimize impact between the tube and any resistance which might be encountered on said one of said second and fourth side walls, said dome support member having a hinged projection along which it is adhered to said third side wall.

2. The packaging sleeve or carton according to claim 1 wherein said dome support member and said cushioning flap comprise complementary concave and convex edges respectively, formed by cutting along a preform.

3. The packaging sleeve or carton according to claim 1 wherein said dome support member extends straight across said carton from said first side wall to said third side wall as determined by the width of said wide band portion.

4. The packaging sleeve or carton according to claim 1 wherein said dome support member extends straight across from said first side wall to said third side wall as determined by the width of said hinged projection.

5. The packaging sleeve or carton according to claim 1 wherein said dome support member extends straight across from said first side wall to said third side wall as determined by the respective widths of said wide band portion and said hinged projection.

6. The packaging sleeve or carton of claim 1 wherein said dome support extends across from said first side wall of said third side wall along a pair of angled portions as determined by respective widths of said wide band portion and said hinged projection.

7. The packaging sleeve or carton according to claim 6 wherein said dome support member and said cushioning flap each includes a hinge line effecting angled sections on opposite sides thereof.

8. The packaging sleeve or carton according to claim 1 wherein said dome support member comprises a concave supporting edge.

9. The packaging sleeve or carton according to claim 1 wherein said cushioning flap comprises an inclined edge extending from said relatively narrow band portion at an inclination away from said dome support member whereby no interference will be encountered between said cushioning flap and said dome support member.

10. The packaging sleeve or carton according to claim 9 wherein said dome support member comprises a concave supporting edge.

11. A foldable protective packaging sleeve or carton of paperboard material for an electronic tube or the like, wherein in the erected condition thereof said sleeve or carton comprises: two pairs of generally parallel panels, the panels of one of said pairs of panels constituting first and third side walls and the panels of the other of said pairs of panels constituting second and fourth side walls around said carton, said second, third, and fourth side walls extending successively from said first side wall along successive mutually parallel fold lines, said fourth side wall having an assembly panel integral therewith and extending beneath and adhered to an adjacent inside portion of said first side wall, said assembly panel including a first relatively elongate band portion extending along said adjacent inside portion of said first side wall for substantially the entire length thereof and a second relatively short band portion disposed beneath and adhered to said adjacent inside portion of said first side wall at one end thereof, said first relatively elongate band portion having a flexible cushioning flap integral therewith and extending from one edge thereof to a free or unattached edge toward said third side wall, said second relatively short band portion having a dome support member integral therewith and extending from one edge thereof to and adhered to an inside portion of said third side wall opposite from said first side wall whereby said dome support member extends from said first side wall to said third side wall adjacent one end of said carton and is secured at opposite ends thereof to said carton, said one edge of said first relatively elongate band portion from which said flexible cushioning flap extends and said one edge of said second relatively short band portion from which said dome support member extends being substantially in line with each other and with little or no offset therebetween whereby no interference will be encountered when said cushioning flap and said dome support member are hinged or folded, said flexible cushioning flap being deflectable toward said one of said second and fourth side walls by one side of a tube inserted into said carton to minimize impact between the tube and any resistance which might be encountered on said one of said second and fourth side walls, said dome support member having a hinged projection along which it is adhered to said third side wall.

12. A blank of paperboard material for forming a foldable protective packaging sleeve or carton for an electronic tube or the like comprising four successive generally rectangular main panels extending along successive fold lines spaced from and mutually parallel to each other and to an edge of a first one of said main panels, the fourth of said main panels having an assembly panel integral therewith, said assembly panel including an elongate, relatively narrow band portion extending for the major portion of the length of said assembly panel, said assembly panel also including a short, relatively wide band portion disposed adjacent one end of said assembly panel, said relatively narrow band portion having a projection integrally hinged thereto for forming a flexible cushioning flap with a free or unattached edge, said relatively wide band portion having an extension integrally hinged thereto for forming a dome support member, said extension also having a further projection which may be secured to an inside surface of the third of said main panels.

* * * * *